US006111202A

United States Patent [19]

Martin

[11] Patent Number: 6,111,202

[45] Date of Patent: Aug. 29, 2000

[54] STACKABLE ELECTRICAL CABLE

[75] Inventor: Demian Martin, Pacifica, Calif.

[73] Assignee: Monster Cable Products, Inc., Brisbane, Calif.

[21] Appl. No.: 09/004,167

[22] Filed: Jan. 2, 1998

[51] Int. Cl.[7] ..... H01B 7/00

[52] U.S. Cl. ..... 174/110 R; 174/111; 174/117 R

[58] Field of Search ..... 174/110 R, 111, 174/117 F, 117 R, 72 A, 115

[56] References Cited

U.S. PATENT DOCUMENTS

| | | | |
|---|---|---|---|
| D. 185,856 | 8/1959 | Scofield et al. | 174/117 R X |
| 2,081,634 | 5/1937 | McNamee | 174/115 |
| 2,581,472 | 1/1952 | Dudley et al. | 174/117 F |
| 2,969,421 | 1/1961 | Scott, Jr. | 174/117 R |
| 4,058,704 | 11/1977 | Shimizu | 174/117 F X |
| 4,230,895 | 10/1980 | Emmel | 174/117 F X |
| 4,369,391 | 1/1983 | Micheron | 174/117 F X |
| 4,847,443 | 7/1989 | Basconi | 174/117 R X |
| 5,113,036 | 5/1992 | Arroyo et al. | 174/117 R X |
| 5,811,735 | 9/1998 | Quiroz | 174/117 F |

*Primary Examiner*—Kristine Kincaid
*Assistant Examiner*—Chau N. Nguyen
*Attorney, Agent, or Firm*—LaRiviere, Grubman & Payne, LLP

[57] ABSTRACT

Insulated wire or cable, the configuration of which is particularly well suited to the orderly coiling of the cable. The cable's insulation is formed in such a manner as to provide interlocking mating surfaces, which surfaces tend to hold the cable in its coiled configuration once so formed. According to one embodiment, the cable is splittable into its component insulated wires for mechanical or electrical connection thereto. This splitting may be by a slit or notch partially transecting a cross section of the insulated cable. Pulling the plurality of insulated wires in opposite directions tends to separate the cable into its component insulated wire portions. The stackable cable may be implemented utilizing cables; coaxial cables; solid wires; multiple strand wires, whether straight or twisted; and non-metallic electrical conductors.

7 Claims, 2 Drawing Sheets

FIG. 1
(Prior Art)
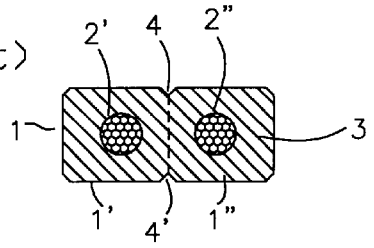
FIG. 2
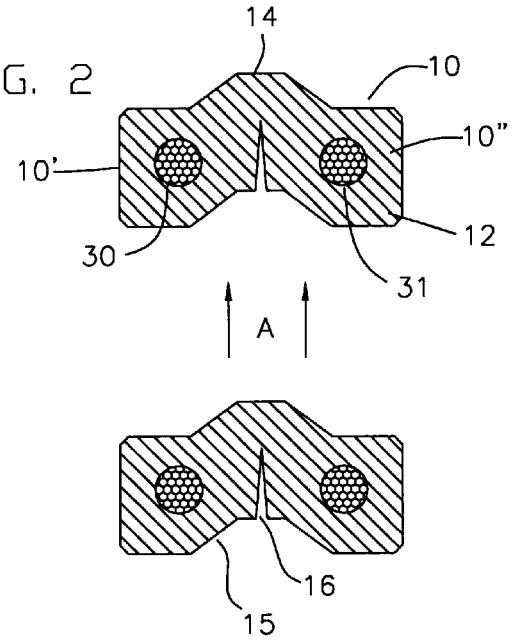
FIG. 3
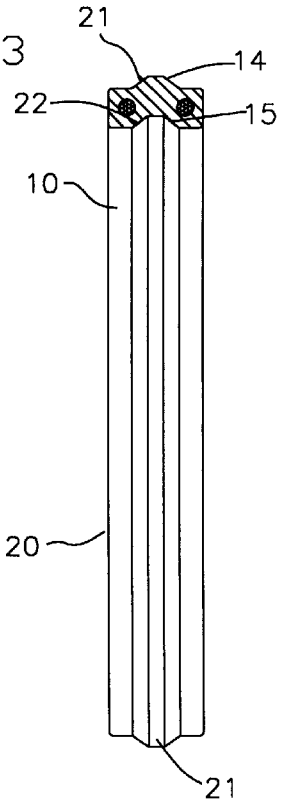
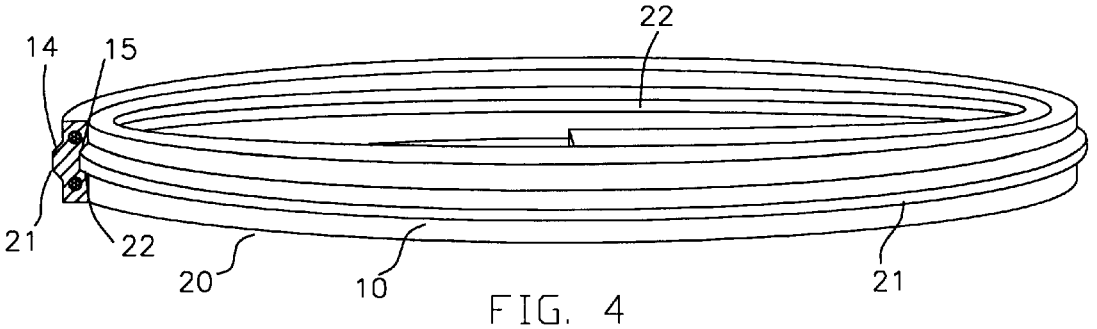
FIG. 4

STACKABLE ELECTRICAL CABLE

TECHNICAL FIELD

The present invention relates to electrical wire and cable. More particularly, the present invention teaches an external configuration for a multiple connector cable particularly suitable for the orderly vertical stacking of the cable on a spool, drum, spindle or the like. The external configuration consists of a raised protrusion on an upper, or first, surface of the cable and a matching depression formed in a lower, or second surface thereof. In operative combination, for instance when forming a coil of cable in accordance with the principles of the present invention, the protrusion formed on one side of the insulation mates with the depression formed in the opposite side of the wire in the next layer in the coil. In this manner, cabling formed in accordance with the principles of the present invention tends to remain coiled in its ideal or pancake form once so disposed.

BACKGROUND OF THE INVENTION

Dual conductor electrical cable suitable for light duty electrical use, commonly referred to as "zip" wire, is in use in many applications. A depiction of this wire, or cable, design is shown in prior art FIG. 1.

FIG. 1 details a cross section of a length of zip wire. Having reference to that figure, zip wire 1, is formed of a mass of flexible, electrically insulating material 3, such as vinyl, rubber, or any of a variety of monomeric or polymeric isomers. Commonly formed by extrusion, casting, melt-pulling, or the like, zip wire 1 typically contains a plurality, usually two, wires 2' and 2". Zip wire 1 typically takes the form in cross section of a rounded rectangle having a pair of medially disposed and opposed notches 4 and 4'. To affect the independent attachment, whether it be electrical, mechanical, or a combination thereof, the separation of zip wire 1 along the axis defined between notches 4 and 4' results in the formation of two separate insulated wires, 1' and 1".

While the previously discussed zip wire configuration may be utile for its intended electrical and mechanical purposes, its external form renders it less that optimal in some applications, and for some marketing and packaging purposes. The spooling of bulk amounts of zip wire onto bulk spools or drums presents no particular difficulty. Such spooling typically takes the form of helically winding the wire about the shank of the drum or spool to form a complete layer thereby. On the completion of the formation of a first single layer winding continues, again helically but in the opposite direction, to form a second single layer overlaying the first layer, and so forth. While this method of storage is satisfactory for many bulk applications, it is unsuitable for a use where a given wire, hereafter referred to as a cable, is formed into an assembly having one or more electrical connectors electrically and mechanically assembled to the cable.

Where such an assembly is formed, for instance a speaker cable assembly, a preferred method for compactly storing the cable is as a "pancake". These "pancakes" typically comprise a length of cable, terminated at either end, and are wound in an expanding helix such that the resultant coil is one cable's width wide. An example of this pancake coil, illustrating the features of the present invention, is shown in FIGS. 3 and 4. This single layer helix, or pancake, may then be placed for marketing purposes inside a variety of display packages, for instance clear plastic blister packs having a pasteboard back, for ultimate sale to the retail customer.

Unfortunately, the external form of zip wire is ill-suited to retaining the resultant pancake coil in its coiled form neatly, attractively, and compactly for these types of marketing and display purposes.

New Monster Cables® is manufactured by Monster Cable® of South San Francisco, Calif. This high performance two-conductor speaker cable is used by audiophiles to improve and enhance the performance of their audio systems by transmitting from the amplifiers thereof to the speakers thereof an exceptionally clear audio signal with minimal signal loss. Monster Cable® defines several improvements over the previously discussed zip wire including, but not necessarily limited to, Time Correct® windings, Magnetic Flux Tube® construction, and specialized dielectric insulation. These improvements, as well as increases in wire size over zip wire, serve to reduce signal loss while maintaining exceptional fidelity of transmission of the audio signal to a degree unattainable with common electrical zip wire. While the interior form of New Monster Cable® presents these advantages over zip wire, its external form is somewhat similar to that of zip wire, although generally of somewhat larger scale.

New Monster Cable® is often marketed as a complete cable assembly, terminated with Monster Cable's® proprietary connectors, as previously discussed. Because the insulating, or dielectric, material which insulates the several wires of the cable tends to have a low coefficient of friction, maintaining the pancake assembly cables in its coiled configuration between the time such pancakes are formed, and the time they are placed into the display packages, is problematic. The cable layers tend to slip axially with respect to one another, thereby destroying the neat appearance required of the pancake configuration. Maintaining the pancake configuration with wire or cable of this type requires inordinate amounts of effort and time to effect the neat packaging thereof.

What is needed then is a configuration for insulated wires and cables, including multi-wire insulated cables, which presents the advantages inherent in the design of Monster Cable®, while obviating the disadvantages previously discussed in forming neat pancakes of cable, which disadvantages are caused by zip wire's external configuration.

DISCLOSURE OF INVENTION

The present invention provides a novel configuration for insulated wire or cable (hereafter referred to as cable), which configuration is particularly well suited to the orderly coiling of the cable. A preferred embodiment of the present invention, as taught in the section entitled "BEST MODE OF CARRYING OUT THE INVENTION", details a two-conductor insulated cable usable in any application where a zip wire, or a similar configuration insulated wiring, is desirable. The insulated cable of the present invention differs from zip wire in that the dielectric forming the cable's insulation is formed in such a manner as to provide interlocking mating surfaces, which surfaces tend to hold the cable in its coiled configuration once so formed.

A cross section of cable constructed according to the principles of the present invention reveals a protrusion on an upper, or first, surface thereof. A matching depression is formed in a lower, or second, surface of the cable. In operative combination, for instance when coiling a coil of cable formed in accordance with the principles of the present invention, the protrusion formed on one side of the insulation mates with the protrusion formed in the opposite side of the cable in the next layer in the coil. In this manner, cable formed in accordance with the principles of the present invention tends to remain coiled in its ideal or pancake form.

Zip wire has the property of being readily splittable into its component insulated wires, for instance for mechanical or electrical connections thereto. The present invention implements this feature, in at least one embodiment thereof, by means of a slit or notch partially transacting a cross section of the insulated cable. Pulling the plurality of insulated wires in opposite directions will tend to separate the cable formed hereby into its component insulated wire portions in a manner similar to zip wire.

Other features of the present invention are disclosed or apparent in the section entitled "BEST MODE OF CARRYING OUT THE INVENTION".

BRIEF DESCRIPTION OF THE DRAWINGS

For fuller understanding of the present invention, reference is made to the accompanying drawing in the following detailed description of the Best Mode of Carrying Out the Invention. In the drawing:

FIG. 1 is a cross section of prior art zip wire.

FIG. 2 is a cross sectional representation of two adjacent sections of insulated cable formed in accordance with the principles of the present invention.

FIG. 3 is a vertical plan view of a pancake coil of wire formed utilizing the principles taught herein.

FIG. 4 is a perspective view of a pancake coil of wire formed utilizing the principles taught herein.

Figure 5:
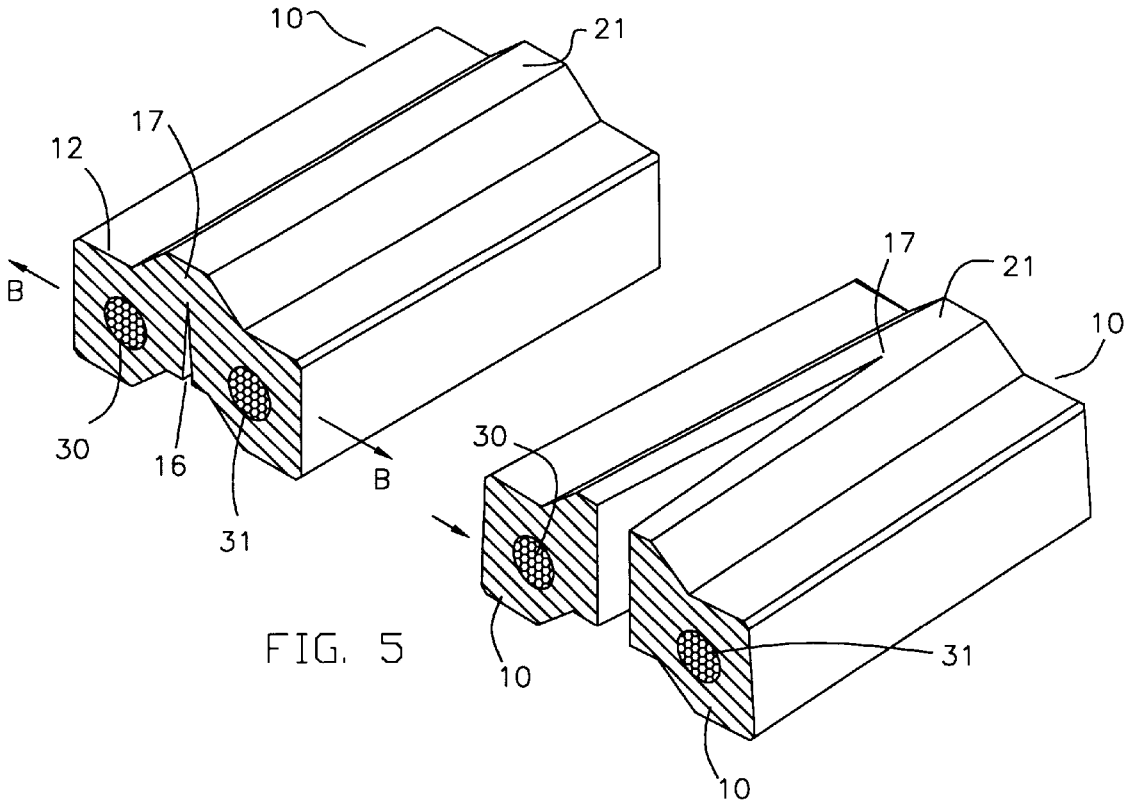
FIG. 5 is a cross-sectional representation of an insulated cable constructed according to the principles of the present invention, demonstrating the cables separation into its individual inserted wires.

Reference numbers refer to the same or equivalent parts of the invention throughout the several figures of the drawing.

BEST MODE OF CARRYING OUT THE INVENTION

Referring now to FIG. 2, the cross-sectional representation of twoconductor cable, 10, constructed according to the principles of the present invention is shown. Having reference to that figure, insulated cable 10 comprises a mass of dielectric 12 having imbedded therein a pair of conductive wires 30 and 31. In a preferred embodiment of the present invention dielectric 12 is a linear polyethylene (LPE) dielectric, and wires 30 and 31 utilize Monster Cable's Time Correct® wound copper wire, as taught in U.S. Pat. No. 4,538,023, and Magnetic Flux Tube® construction, as taught in U.S. Pat. No. 4,734,544. Other wire configurations, both novel and those well known to those having ordinary skill in the art may, with equal facility be utilized where desired.

Dielectric 12 is formed to perform the advantages taught herein in the following manner: An upper, or first surface of the cable's dielectric 12, is formed with a protrusion 14. A lower or second surface of the cable's dielectric 12 is formed with a matching depression, 15. The cross-sectional proportions of protrusion 14 enable its mating, or nesting, within depression 15 in a coiled cable configuration. According to a first preferred embodiment of the present invention, a notch or slit 16 is further provided in at least one of protrusion 14 and depression 15 to enable a workman to easily separate cable 10 into a plurality of individual insulated wires 10' and 10". In one preferred embodiment of the present invention slit 16 may be formed adjacent to depression 15. Alternatively, slit 16 may, with equal facility, be formed in conjunction with protrusion 14, and may, as a further alternative, be formed in both protrusion 14 and depression 15. The formation of dielectric 12 is preferably accomplished by extrusive means, but alternative formation methodologies including, but not necessarily limited to: casting; sintering; molding; and vacuum forming may, with equal facility be utilized.

It will be noted that in this preferred embodiment, protrusion 14 and mating depression 15 take the form of a rounded trapezoid. Other applications may require the use of alternative geometric forms including, but not limited to square, rectangle, arcuate, circular, ovoid, triangular, conical, elliptical, parabolic, hyperbolic, other regular geometric forms and specialized shapes required by a given application. The present invention specifically contemplates all such forms and shapes. Further, protrusion 14 and mating depression 15 may alternatively be formed to include a barb, detent, or similar device (not shown) to more intimately retain adjacent coils of wire 10 in mated contact.

Referring now to FIGS. 2 and 3, when a workman forms cable 10 into a coil or pancake as previously discussed, protrusion 14 of a lower coil of cable 10 is urged in the direction marked "A". This results in the protrusion mating with depression 15 of an upper, or subsequent coil of cable 10. This mating tends to reduce the slippage between adjacent coils of cable 10 thereby tending to retain cable 10 in its coiled formation when so wound.

FIGS. 3 and 4 show the formation of a pancake of cable utilizing the principles of the present invention. Having reference to those figures, cable 10 is wound flatly and concentrically into the flat helix, or pancake 20, shown in FIG. 3. This concentric winding forms a ridge, 21 of protrusion 14, about one surface of the pancake. As successive layers of cable 10 are wound about pancake 20, the longitudinal notch 22 formed by depression 15 is engaged with ridge 21, thereby tending to retain a second layer of cable 10 in axial alignment with a first layer thereof.

Having reference now to FIG. 5, the separation of one embodiment of cable 10 into its component insulated wires is shown. Having reference to that figure, a length of twisted multiple-strand wire 10 is shown being pulled as shown in the directions of the arrows marked B and B'. This pulling tends to separate dielectric 12 as shown, whereby notch or slit 16 propagates or spreads through dielectric 12 at 17. This separation results in the splitting of cable 10 into, in this first preferred embodiment, a pair of insulated wires 10' and 10". Subsequent to this splitting, wires 10' and 10" may be stripped, attached, electrically and/or mechanically connected and/or terminated in any manner well known to those having ordinary skill in the art.

FIG. 5 details the splitting of a cable 10 having a pair of conductors 30 and 31, insulated by dielectric 12 and splittable into two separate insulated wires 30 and 31. Similar cables having either a single conductor, a pair of conductors, 30 and 31 as shown, or a larger plurality of conductors, as may be required in other applications, could, with equal facility be implemented. The principles of the present invention specifically contemplate all such embodiments.

While the previously discussed first preferred embodiment contemplates a pair of insulated wires, study of the invention disclosed herein renders obvious the fact that the principles of the present invention may, with equal facility, be implemented to include a wide variety of electrical conductors. Such conductors include, but are specifically not limited to: cables; coaxial cables; solid wires; multiple strand wires, whether straight or twisted; and non-metallic electrical conductors.

Figure 6:
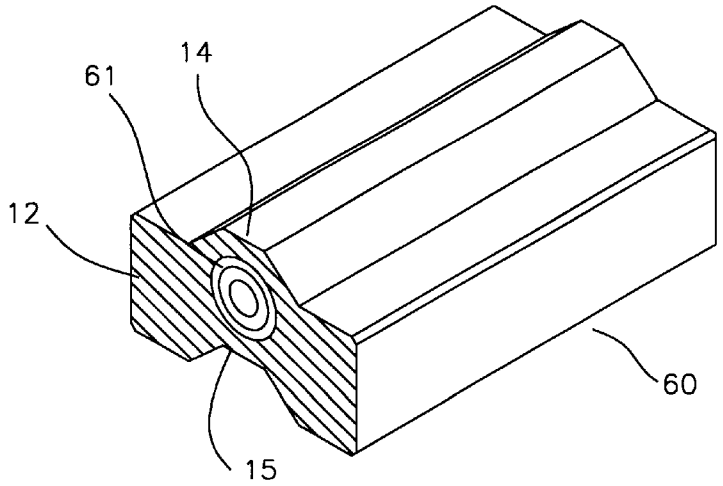
FIG. 6 is a cross-sectional representation of a single insulated coaxial cable constructed according to the principles of the present invention.

The principles of the present invention specifically contemplate the formation of a stackable coaxial cable. Such an embodiment is shown in FIG. 6 at 60. Stackable coaxial cable 60, in this embodiment, comprises a single coaxial cable 61, formed within a mass of dielectric 12 formed as before to define mating protrusion 14 and depression 15. Since this embodiment incorporates a single coaxial cable 61, slit 16, enabling the splitting of the cable, is omitted. Where a plurality of coaxial cables (not shown in this figure) are enclosed in dielectric 12, cable 60 may be implemented in similar fashion as previously shown cable 10 to include slit 16 (not shown in this figure), thereby enabling the splitting of cable 60 into a corresponding plurality of dielectric-packaged coaxial cables, 61.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. In particular, alternate mating geometries, wire formations, conductor pluralities, dielectric materials, and notching configurations are all specifically contemplated by the principles of the present invention. The invention disclosed herein may be practiced without any element which is not specifically disclosed herein.

What is claimed is:

1. An electrical assembly particularly well suited to the orderly coiling thereof, the cable assembly comprising:

a first length of electrically conductive wire; and a dielectric forming a single piece surrounding said first length of electrically conductive wire, said dielectric defining in cross-section an upper surface and a lower surface, with a raised engagement protrusion on said upper surface of said dielectric and a matching engagement depression on said lower surface of said dielectric, whereby coiling said cable assembly into a flat, externally radiating helical coil with an upper layer having said upper surface and lower surface and a lower layer having said upper surface and lower surface results in said protrusion on said upper surface of said upper layer of said helical coil mating with said depression on said lower surface of said lower layer of said helical coil, and thereby reducing the slippage between adjacent layers of said helical coil out of a plane formed by the flat helical coil and tending to retain said cable assembly in its helically coiled formation when so wound.

2. An electrical cable assembly, as recited in claim 1, further comprising a second length of electrically conductive wire in parallel relationship with and spaced apart from said first length of electrically conductive wire, wherein the dielectric surrounds the second length of electrically conductive wire, so that the first length of electrically conductive wire is insulated from the second length of electrically conductive wire.

3. An electrical cable assembly, as recited in claim 2, wherein said protrusion and depression are centered between said first length of electrically conductive wire and said second length of electrically conductive wire.

4. An electrical cable assembly, as recited in claim 2, wherein said protrusion and depression are aligned so that coiling said cable assembly into said flat, externally radiating helical coil results in said protrusion of said upper layer of said helical coil mating with said depression of said lower layer of said helical coil, and wherein said upper layer of said helical coil is part of the same single piece as said lower layer of said helical coil.

5. The method of forming an electrical cable assembly into a flat, externally radiating helical coil, the method comprising the steps of:

providing a length of electrically conductive wire;

substantially surrounding said wire with a dielectric, said dielectric defining in cross-section a raised engagement protrusion on a first upper surface of said dielectric and a matching engagement depression on a second lower surface of said dielectric; and coiling said cable assembly into said flat, externally radiating helical coil with a first layer having said first upper surface and second lower surface and a subsequent layer having said first upper surface and second lower surface whereby said protrusion on said first upper surface of said first layer of said helical coil mates with said depression on said second lower surface of said subsequent layer of said helical coil, thereby reducing the slippage between adjacent layers of said helical coil and tending to retain said cable assembly in its helically coiled formation when so wound.

6. The method, as recited in claim 5, further comprising the step of embedding another wire in the dielectric parallel to said wire.

7. The method, as recited in claim 6, wherein said protrusion and depression are between said wire and said another wire.

* * * * *